United States Patent [19]

Shubkin

[11] 4,243,538

[45] Jan. 6, 1981

[54] FUEL AND LUBRICATING COMPOSITIONS CONTAINING N-HYDROXYMETHYL ALIPHATIC HYDROCARBYLAMIDE FRICTION REDUCERS

[75] Inventor: Ronald L. Shubkin, West Bloomfield, Mich.

[73] Assignee: Ethyl Corporation, Richmond, Va.

[21] Appl. No.: 46,257

[22] Filed: Jun. 7, 1979

[51] Int. Cl.[3] ..... C10M 1/32

[52] U.S. Cl. ..... 252/51.5 A; 44/71

[58] Field of Search ..... 252/51.5 A; 44/71

[56] References Cited

U.S. PATENT DOCUMENTS

| | | | |
|---|---|---|---|
| 2,403,067 | 7/1946 | Fischer et al. | 252/51.5 A |
| 2,638,449 | 5/1953 | White et al. | 44/71 X |
| 2,922,707 | 1/1960 | Lindstrom et al. | 44/71 X |
| 3,019,187 | 1/1962 | Panzer et al. | 252/51.5 A X |
| 3,251,853 | 5/1966 | Hoke | 252/51.5 A X |
| 3,312,620 | 4/1967 | Low et al. | 252/51.5 A X |
| 4,151,101 | 4/1979 | Anzenberger et al. | 252/51.5 A X |

*Primary Examiner*—Andrew Metz

*Attorney, Agent, or Firm*—Donald L. Johnson; John F. Sieberth; Joseph D. Odenweller

[57] ABSTRACT

Friction of internal combustion engines is reduced by using a formulated motor oil in the engine crankcase which contains a minor amount of an N-hydroxymethyl aliphatic hydrocarbylamide, e.g. N-hydroxymethyl oleamide. The additive can also be used in fuel.

6 Claims, No Drawings

FUEL AND LUBRICATING COMPOSITIONS CONTAINING N-HYDROXYMETHYL ALIPHATIC HYDROCARBYLAMIDE FRICTION REDUCERS

BACKGROUND OF THE INVENTION

In order to conserve energy, automobiles are now being engineered to give improved gasoline mileage compared to those in recent years. This effort is of great urgency as a result of Federal regulations recently enacted which compel auto manufacturers to achieve prescribed gasoline mileage. These regulations are to conserve crude oil. In an effort to achieve the required mileage, new cars are being down-sized and made much lighter. However, there are limits in this approach beyond which the cars will not accommodate a typical family.

Another way to improve fuel mileage is to reduce engine friction. The present invention is concerned with this latter approach.

Use of substituted fatty acid amides in lubricating oil is disclosed in U.S. Pat. No. 3,746,644. Lubricating oil containing ethoxylated fatty acid amide demulsifiers is mentioned in U.S. Pat. No. 3,509,052. Likewise, fatty acid amides of alkanolamines such as diethanolamine are disclosed as corrosion inhibitors in turbine oil in U.S. Pat. No. 2,403,067. Other pertinent references are U.S. Pat. No. 2,018,758 and U.S. Pat. No. 2,967,831.

SUMMARY OF THE INVENTION

Fuel efficient oil for internal combustion engines is provided by including in the formulated oil a minor amount an N-hydroxymethyl $C_{12-36}$ aliphatic hydrocarbylamide. The additives can also be used in the engine fuel to reduce friction.

DESCRIPTION OF THE PREFERRED EMBODIMENTS

A preferred embodiment of the invention is a lubricating oil composition formulated for use in the crankcase of an internal combustion engine, said composition comprising a major amount of a lubricating oil and a minor friction-reducing amount of an oil-soluble aliphatic N-hydroxymethyl hydrocarbylamide having the structure

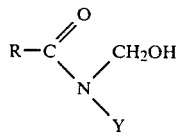

wherein R is an aliphatic hydrocarbon group containing 11–35 carbon atoms and Y is selected from the group consisting of hydrogen, lower alkyls containing 1–4 carbon atoms and hydroxymethyl.

Representative examples of these additives are:

N-hydroxymethyl dodecamide
N,N-bis(hydroxymethyl)dodecamide
N-hydroxymethyl-N-methyl tetradecanamide
N-hydroxymethyl-N-ethyl eicosanamide
N-hydroxymethyl tetracosanamide
N,N-bis(hydroxymethyl)triacontanamide
N-hydroxymethyl heptatriacontanamide
N-hydroxymethyl oleamide
N,N-bis(hydroxymethyl)oleamide
N-hydroxymethyl stearylamide N,N-bis(hydroxymethyl)stearylamide
N-hydroxymethyl linoleamide
N,N-bis(hydroxymethyl)linoleamide
N-hydroxymethyl tall oil fatty acid amide
N,N-bis(hydroxymethyl) tall oil fatty acid amide The most preferred additives are N-hydroxymethyl oleamide, N,N-bis(hydroxymethyl)oleamide and mixtures thereof.

The additives are made by the known method of reacting an appropriate aliphatic hydrocarbylamide with formaldehyde. The reaction proceeds at a good rate at about 50°–100° C. using a base catalyst such as sodium carbonate.

The method of making the additive is shown by the following examples.

EXAMPLE 1

In a reaction vessel was placed 95 gms of octadecanamide, 78.9 gms of 38% aqueous formaldehyde and 5 gms of sodium carbonate. The mixture was stirred under nitrogen at 50° C. for two hours and then heated to 75° C. for one hour. Following this, 200 ml n-butanol was added and stirring continued for 0.5 hour at 60° C. The mixture was cooled and filtered to remove the white solid product. Analysis was carbon–71.1 wt %, hydrogen–12.4 wt %, and nitrogen–4.1 wt %. Infrared analysis indicated that the product was about 60% N-hyroxymethyl octadecanamide and 40% N,N-bis(hydroxymethyl)octadecanamide.

EXAMPLE 2

In a reaction vessel was placed 194 gms oleamide, 210 gms 37% aqueous formaldehyde, 10 gms sodium carbonate and 400 ml n-butanol. The mixture was stirred under nitrogen at 60° C. for four hours. Then 200 ml toluene was added and the aqueous phase removed. The organic layer was washed three times with water. The third wash emulsified and a small amount of sodium sulfate was added to break the emulsion. The organic layer was dried over calcium sulfate, filtered and volatiles removed under vacuum using a rotary evaporator. Product yield was 206.8 gms which was mainly N-hydroxymethyl oleamide containing some N,N-bis(hydroxymethyl)oleamide.

Other similar additives can be made following the above general procedure by substituting other aliphatic hydrocarbyl amides having at least one hydrogen bonded to the amide nitrogen. Such amides include laurylamide, N-methyl tridecanamide, N-ethyl oleamide, eicosanamide, heptatriacontanamide, stearylamide, linoleamide, tall oil fatty acid amide and the like.

The additives are added to the lubricating oil in an amount which reduces the friction of the engine operating with the oil in the crankcase. A useful concentration is about 0.05–3 wt %. A more preferred range is about 0.1–1.0 wt %.

From the above it can be seen that the present invention provides an improved crankcase lubricating oil. Accordingly, an embodiment of the invention is an improved motor oil composition formulated for use as a crankcase lubricant in an internal combustion engine wherein the improvement comprises including in the crankcase oil an amount sufficient to reduce fuel consumption of the engine of the friction-reducing additive herein described.

The additives can be used in mineral oil or in synthetic oils of viscosity suitable for use in the crankcase of an internal combustion engine. Crankcase lubricating oils have a viscosity up to about 80 SUS at 210° F.

Mineral oils include those of suitable viscosity refined from crude oil from all sources including Gulfcoast, midcontinent, Pennsylvania, California, Alaska and the like. Various standard refinery operations can be used in processing the mineral oil.

Synthetic oil includes both hydrocarbon synthetic oil and synthetic esters. Useful synthetic hydrocarbon oils include liquid polymers of α-olefins having the proper viscosity. Especially useful are the hydrogenated liquid oligomers of $C_{6-12}$ α-olefins such as α-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylol propane tripelargonate, pentaerythritol tetracaproate, di(2-ethylhexyl)adipate, dilauryl sebacate and the like. Complex esters prepared from mixtures of mono- and dicarboxylic acid and mono- and polyhydroxyl alkanols can also be used.

Blends of mineral oil with synthetic oil are particularly useful. For example, blends of 5–25 wt % hydrogenated α-decene trimer with 75–95 wt % 150 SUS (100° F.) mineral oil results in an excellent lubricant. Likewise, blends of about 5–25 wt % di(2-ethylhexyl-)adipate with mineral oil of proper viscosity results in a superior lubricating oil. Also blends of synthetic hydrocarbon oil with synthetic esters can be used. Blends of mineral oil with synthetic oil are especially useful when preparing low viscosity oil (e.g. SAE 5W 20) since they permit these low viscosities without contributing excessive volatility.

The more preferred lubricating oil compositions include zinc dihydrocarbyldithiophosphate (ZDDP) in combination with the present additives. Both zinc dialkyldithiophosphates and zinc dialkaryldithiophosphates as well as mixed alkyl-aryl dithiophosphates can be used. Examples of alkyl-type ZDDP are those in which the hydrocarbyl groups are a mixture of isobutyl and isoamyl alkyl groups. Zinc di-(nonylphenyl)-dithiophosphate is an example of an aryl-type ZDDP. Good results are achieved using sufficient zinc dihydrocarbyldithiophosphate to provide about 0.01–0.5 wt % zinc. A preferred concentration supplies about 0.05–0.3 wt % zinc.

In a highly preferred embodiment of formulated motor oil compositions include an alkaline earth metal petroleum sulfonate or alkaline earth metal alkaryl sulfonates. Examples of these are calcium petroleum sulfonates, magnesium petroleum sulfonates, barium alkaryl sulfonates, calcium alkaryl sulfonates or magnesium alkaryl sulfonates. Both the neutral and the overbased sulfonates having base numbers up to about 400 can be beneficially used. These are used in an amount to provide about 0.05–1.5 wt % alkaline earth metal and more preferably about 0.1–1.0 wt %.

Viscosity index improvers can be included such as the polyalkylmethacrylate type or the ethylene-propylene copolymer type. Likewise, styrene-diene or styrene-acrylate copolymer VI improvers can be used. Alkaline earth metal salts of phosphosulfurized isobutylene are useful.

Preferred crankcase oils also contain an ashless dispersant such as the polyolefin succinamides and succinimides of polyethylene polyamines such as tetraethylenepentamine. The polyolefin succinic substituent is preferably a polyisobutene group having a molecular weight of from about 800 to 5,000. Such ashless dispersants are more fully described in U.S. Pat. Nos. 3,172,892 and 3,219,666, incorporated herein by reference.

Other useful ashless dispersants include the Mannich condensation products of polyolefin-substituted phenols, formaldehyde and polyethylene polyamine. Preferably, the polyolefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. Nos. 3,368,972; 3,413,347; 3,442,808; 3,448,047; 3,539,633; 3,591,598; 3,600,372; 3,634,515; 3,697,574; 3,703,536; 3,704,308; 3,725,480; 3,726,882; 3,736,357; 3,751,365; 3,756,953; 3,793,202; 3,798,165; 3,798,247 and 3,803,039.

The friction-reducing additives of this invention are also useful in fuel compositions. Fuel injected or inducted into a combustion chamber wets the walls of the cylinder. Fuels containing a small amount of the present additive reduce the friction due to the piston rings sliding against the cylinder wall.

The additives can be used in both diesel fuel and gasoline used to operate internal combustion engines. Fuels containing about 0.001–0.25 wt % of the friction-reducing additives can be used.

Fuels used with the invention can contain any of the additives conventionally added to such fuels. In the case of gasoline it can include dyes, antioxidants, detergents, antiknocks (e.g. tetraethyllead, methylcyclopentadienyl-manganese tricarbonyl, rare earth metal chelates, methyl tert-butylether and the like). In the case of diesel fuels the compositions can include pour point depressants, detergents, ingnition improvers (e.g. hexylnitrate) and the like.

Tests were carried out which demonstrated the friction-reducing properties of the additives. These tests have been found to correlate with fuel economy tests in automobiles. In these tests an engine with its cylinder head removed and with the test lubricating oil in its crankcase was brought to 1800 rpm by external drive. Crankcase oil was maintained at 63° C. The external drive was disconnected and the time to coast to a stop was measured. This was repeated several times with the base oil and then several times with the same oil containing commercial oil formulated for use in a crankcase. The following table shows the percent increase in coast-down time caused by the present additives.

| Additive | Conc (wt %) | Percent Increase |
|---|---|---|
| N-hydroxymethyl oleamide | 0.25 | 3.5 |
| N-hydroxymethyl oleamide | 0.5 | 5.7 |
| N-hydroxymethyl oleamide | 1.0 | 6.5, 13[1] |

[1]This result obtained using a different base oil

Further tests were conducted using a 1977 U.S. production automobile. These were shortened versions of the Federal City EPA cycle. This is referred to as the "Hot 505" cycle. It consists of the first 3.6 miles of the Federal EPA city cycle started with a warmed-up engine instead of a cold engine. The car with a fully formulated SE grade oil in its crankcase is operated on a chassis dynamometer for about one hour at 55 mph to stabilize oil temperature. It is then run through four consecutive "Hot 505" cycles measuring fuel economy of the base oil. Results of the four cycles are averaged. Then one-half of the base oil is drained from the crankcase and replaced with the same base oil containing a double dose of the test additive. The car is then run at 55 mph for about one hour to again stabilize temperature. A second series of four consecutive "Hot 505" cycles is run to measure initial fuel economy of the base oil containing the test additive. The car is then run 500 miles at constant 55 mph. Then a third series of four consecutive "Hot 505" cycles are run to measure fuel economy after 500 miles operation on the oil containing the test additive. The crankcase is then drained hot and filled with flushing oil which is run for a short time and then drained. The crankcase is then filled a second time with base oil. This is run about one hour at 55 mph to a stable temperature. Then a fourth series of four consecutive "Hot 505" cycles are run measuring fuel economy. This gives a second base line thus bracketing the test carried out with the friction additive between two base line tests.

The following table shows the percent improvement in fuel economy over the base oil obtained using 1 weight percent of the friction-reducing additive.

| Additive | % Gain In Fuel Economy | |
|---|---|---|
| | Initial | 500 Miles |
| N-hydroxymethyl oleamide | 0 | 0.5 |

The reduction in fuel consumption though small is significant. Fuel economy improved with mileage.

I claim:

1. A lubricating oil composition formulated for use in the crankcase of an internal combustion engine, said composition comprising a major amount of a hydrocarbon lubricating oil and a minor friction-reducing amount of an oil-soluble aliphatic N-hydroxymethyl hydrocarbylamide having the structure

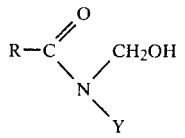

wherein R is an aliphatic hydrocarbon group containing 11–35 carbon atoms and Y is selected from the group consisting of hydrogen, lower alkyls containing 1–4 carbon atoms and hydroxymethyl.

2. A lubricating oil composition of claim 1 wherein said amide is selected from the group consisting of N-hydroxymethyl oleamide, N,N-bis(hydroxymethyl-)oleamide and mixtures thereof.

3. A lubricating oil composition of claim 1 wherein said amide is selected from the group consisting of N-hydroxymethyl stearylamide, N,N-bis(hydroxymethyl)-stearylamide and mixtures thereof.

4. A lubricating oil composition of claim 1 wherein said amide is selected from the group consisting of N-hydroxymethyl linoleamide, N,N-bis(hydroxymethyl)-linoleamide and mixtures thereof.

5. A lubricating oil composition of claim 1, 2, 3 or 4 wherein said lubricating oil is selected from mineral lubricating oil and synthetic hydrocarbon oils of lubricating viscosity and mixtures thereof.

6. A liquid hydrocarbon fuel suitable for use in an internal combustion engine comprising a major amount of liquid hydrocarbon fuel and a minor friction-reducing amount of an oil-soluble aliphatic N-hydroxymethyl $C_{12-36}$ hydrocarbylamide.

* * * * *